US008746005B2

(12) United States Patent
Yoon

(10) Patent No.: US 8,746,005 B2
(45) Date of Patent: Jun. 10, 2014

(54) REFRIGERATOR

(75) Inventor: Chan-Mun Yoon, Changwon (KR)

(73) Assignee: LG Electronics Inc., Seoul (KR)

( * ) Notice: Subject to any disclaimer, the term of this patent is extended or adjusted under 35 U.S.C. 154(b) by 1347 days.

(21) Appl. No.: 12/517,868

(22) PCT Filed: Dec. 26, 2007

(86) PCT No.: PCT/KR2007/006848
§ 371 (c)(1),
(2), (4) Date: Nov. 8, 2010

(87) PCT Pub. No.: WO2008/082141
PCT Pub. Date: Jul. 10, 2008

(65) Prior Publication Data

US 2011/0041538 A1 Feb. 24, 2011

(30) Foreign Application Priority Data

Jan. 2, 2007 (KR) ..... 10-2007-0000319
Jan. 2, 2007 (KR) ..... 10-2007-0000320
Jan. 2, 2007 (KR) ..... 10-2007-0000321

(51) Int. Cl.
*F25D 17/04* (2006.01)

(52) U.S. Cl.
USPC ..... 62/408; 62/419

(58) Field of Classification Search
CPC ..... F25D 21/08; F25D 23/069; F25D 17/067; F25D 2317/068; F25D 2317/0684; F25D 29/00; F25D 2700/00; F25D 21/008; F25D 17/065; F25B 47/02
USPC ..... 62/275, 441, 408, 419, 131, 155, 187, 62/234
See application file for complete search history.

(56) References Cited

U.S. PATENT DOCUMENTS

| | | | | |
|---|---|---|---|---|
| 3,403,533 | A | 10/1968 | Bollenbacher | |
| 4,569,206 | A * | 2/1986 | Mitani et al. | 62/156 |
| 4,852,361 | A * | 8/1989 | Oike | 62/131 |
| 4,858,443 | A * | 8/1989 | Denpou | 62/126 |
| 4,970,870 | A * | 11/1990 | Midlang et al. | 62/126 |
| 5,209,073 | A | 5/1993 | Thomas et al. | |
| 5,392,615 | A * | 2/1995 | Lim | 62/414 |
| 5,899,083 | A | 5/1999 | Peterson et al. | |
| 5,970,736 | A * | 10/1999 | Gong et al. | 62/408 |
| 6,094,932 | A * | 8/2000 | Chiappetta | 62/408 |
| 6,725,678 | B2 | 4/2004 | Chang et al. | |
| 6,865,905 | B2 * | 3/2005 | Hu | 62/407 |

(Continued)

FOREIGN PATENT DOCUMENTS

| | | |
|---|---|---|
| AU | 86963/91 B | 5/1992 |
| EP | 1 559 973 B1 | 1/2007 |

(Continued)

*Primary Examiner* — Mohammad M Ali
(74) *Attorney, Agent, or Firm* — Birch, Stewart, Kolasch & Birch, LLP

(57) ABSTRACT

The present invention provides a refrigerator including an outer casing, an inner casing mounted inside the outer casing to define a refrigerating chamber and a freezing chamber, an evaporator installed between the outer casing and the inner casing to supply cool air, a separate room positioned in any one of the refrigerating chamber and the freezing chamber, and a passage for gliding the cool air generated by the evaporator directly to the separate room. In this configuration, the cooling efficiency of the separate room can be improved.

15 Claims, 8 Drawing Sheets

(56) References Cited

U.S. PATENT DOCUMENTS

| | | | | |
|---|---|---|---|---|
| 7,007,490 | B2 | 3/2006 | Jeong et al. | |
| 7,174,734 | B2 * | 2/2007 | Davern et al. | 62/187 |
| 7,770,406 | B2 * | 8/2010 | Yoshioka et al. | 62/199 |
| 2005/0217287 | A1 | 10/2005 | Jeong et al. | |

FOREIGN PATENT DOCUMENTS

| | | | |
|---|---|---|---|
| EP | 1 628 108 | B1 | 12/2008 |
| JP | 2003-172573 | A | 6/2003 |
| KR | 10-2005-0058040 | B1 | 6/2005 |

* cited by examiner

REFRIGERATOR

TECHNICAL FIELD

The present invention relates to a refrigerator, and more particularly, to a refrigerator having a cool air supply passage for supplying cool air directly to a magic room, a freezing chamber, and a special freezing room defined therein.

BACKGROUND ART

Korean Registered Utility Model Official Gazette No. 0184118 discloses a refrigerator with a freezing chamber and a refrigerating chamber arranged in the up-down direction, the refrigerator including an evaporator for supplying cool air to the freezing chamber, and a cool air supply passage for sending the cool air, supplied to the freezing chamber through the evaporator and circulated in the freezing chamber, to the refrigerating chamber.

In addition, Korean Registered Patent Official Gazette No. 0182726 discloses a refrigerator with a refrigerating chamber and a freezing chamber arranged in the up-down direction, the refrigerator including a refrigerating chamber evaporator for generating cool air to supply the cool air to the refrigerating chamber, a freezing chamber evaporator for generating cool air to supply the cool air to the freezing chamber, a refrigerating chamber passage for supplying the cool air from the refrigerating chamber evaporator to the refrigerating chamber, and a freezing chamber passage for supplying the cool air from the freezing chamber evaporator to the freezing chamber.

FIG. 1 is a view illustrating one example of a conventional refrigerator. The conventional refrigerator includes an outer casing 10 for forming the exterior of the refrigerator, an inner casing 20 mounted inside the outer casing 10 to define a refrigerating chamber R and a freezing chamber F, an evaporator 30 installed between the outer casing 10 and the inner casing 20 to evaporate refrigerant and generate cool air, a blowing km 40 installed in the inner casing 20 to blow the cool air generated by the evaporator 30 to the freezing chamber F, a magic room 50 formed at a bottom end of the refrigerating chamber R to store food or the like, and having a cool air hole 52 to get cool air from the outside, and a damper 60 installed between the refrigerating chamber R and the freezing chamber F to supply the cool air circulated in the freezing chamber F to the magic room 50, and regulating supply of the cool air through the cool air hole 52 of the magic room 50.

However, as the conventional refrigerator supplies the cool air circulated in the freezing chamber F to the magic room 50 through the damper 60, the cooling efficiency of the magic room 50 is degraded and the cooling of the magic room 50 is difficult to control.

FIG. 2 is a view illustrating another example of the conventional refrigerator. The conventional refrigerator includes a freezing chamber F defined by an inner casing 20, an evaporator 30 installed on a rear side of the inner casing 20 to supply cool air to the freezing chamber side F, a cool air supply passage 80 formed in the inner casing 20 to send the cool air supplied by the evaporator 30 to the freezing chamber side F, a grill fan 40 installed on the cool air supply passage 80 to blow the cool air supplied by the evaporator 30 to the freezing chamber F, a special freezing room 50 defined in the freezing chamber F, and a box fan 60 installed in the inner casing 20 to send the cool air supplied by the evaporator 30 directly to the special freezing room 50.

The conventional refrigerator sends the cool air supplied by the evaporator 30 to the special freezing room 50 through the box fin 60 so that the special freezing room 50 can maintain a low temperature state (for example, −35° C.). However, the box fan 60 for supplying the cool air to the special freezing room 50 may be frozen due to the cool air, and thus may not be operated when a user intends to use the special freezing room 50. Moreover, a capacity of the freezing chamber F is reduced due to a separate installation space of the box fan 60. Further, as the grill fan 40 and the box fan 60 are installed together, noise increases.

DISCLOSURE OF INVENTION

Technical Problem

An object of the present invention is to provide a refrigerator having a cool air supply passage capable of supplying cool air from an evaporator directly to separate rooms in a refrigerating chamber and a freezing chamber.

Another object of the present invention is to provide a refrigerator having a cool air supply passage capable of regulating supply of cool air to a freezing chamber and a special freezing room, and increasing a capacity of the freezing chamber.

Another object of the present invention is to provide a refrigerator capable of suppressing noise generated by a fan for blowing cool air, and preventing freezing of a damper for controlling cool air on a cool air supply passage.

Another object of the present invention is to provide a refrigerator having a cool air supply passage capable of improving the cooling efficiency of a magic room and easily regulating the cooling of the magic room.

Technical Solution

According to an aspect of the present invention, there is provided a refrigerator, including: an outer casing; an inner casing mounted inside the outer casing to define a refrigerating chamber and a freezing chamber; an evaporator installed between the outer casing and the inner casing to supply cool air; a separate room positioned in any one of the refrigerating chamber and the freezing chamber; and a passage for guiding the cool air generated by the evaporator directly to the separate room. In this configuration, the cooling efficiency of the separate room can be improved.

According to another aspect of the present invention, the refrigerator further includes a damper for controlling the cool air supplied to the separate room. In this configuration, whether to supply the cool air to the separate room can be determined to regulate the cooling of the separate room.

According to another aspect of the present invention, the refrigerator further includes a heater for preventing freezing of the damper. In this configuration, it is possible to prevent the freezing of the damper operated in an environment of circulating low temperature cool air.

According to another aspect of the present invention, the separate room is a special freezing room positioned in the freezing chamber, and the passage guides the cool air generated by the evaporator to at least one of the freezing chamber and the special freezing room. In this configuration, components for supplying cool air to the freezing chamber and the special freezing room respectively may be omitted to increase a capacity of the freezing chamber.

According to another aspect of the present invention, the refrigerator further includes a damper formed on the passage to control the cool air supplied to the at least one of the freezing chamber and the special freezing room. In this configuration, it is possible to regulate the cool air supplied to the freezing chamber and the special freezing room.

According to another aspect of the present invention, the damper intercepts the cool air supplied to the freezing chamber, while the cool air is supplied to the special freezing room.

According to another aspect of the present invention, the damper includes a damper positioned on the passage on the side of the freezing chamber, and a damper positioned on the passage on the side of the special freezing room. In this configuration, the cool air can be supplied intensively to the special freezing room to improve the cooling efficiency.

According to another aspect of the present invention, the refrigerator further includes a heater for preventing freezing of the damper. In this configuration, it is possible to prevent the freezing of the damper operated in an environment of circulating low temperature cool air.

According to another aspect of the present invention, at least some portion of the passage is a duct for gliding the cool air to the special freezing room. In this configuration, the cool air can be supplied to the special freezing room without being affected by outdoor air.

According to another aspect of the present invention, the evaporator includes a first evaporator for supplying cool air to the refrigerating chamber, and a second evaporator for supplying cool air to the freezing chamber, the separate room is a magic room positioned in the refrigerating chamber, and the passage guides the cool air generated by the first evaporator to the magic room. In this configuration, the cooling efficiency of the magic room can be improved.

According to another aspect of the present invention, the passage is formed between the outer casing and the inner casing.

According to another aspect of the present invention, the inner casing includes a front cover for forming a front surface of the inner casing, and a rear cover for forming a portion of a rear surface of the inner casing, and at least some portion of the passage is formed between the front cover and the rear cover. In this configuration, the passage can be easily formed between the inner casing and the outer casing.

According to another aspect of the present invention, the refrigerator further includes a rear casing positioned between the inner casing and the outer casing to cover the front cover and the rear cover of the inner casing, wherein some portion of the passage is a dirt installed between the outer casing and the rear casing. In this configuration, the cool air can be supplied to the magic room without being affected by the refrigerating chamber.

According to another aspect of the present invention, the passage is formed in the inner casing.

According to another aspect of the present invention, at least some portion of the passage is formed by a duct. In this configuration, the cool air can be supplied to the magic room without an outside interference.

According to another aspect of the present invention, the refrigerator further includes a blowing fan installed on the passage to blow the cool air supplied by the first evaporator to the magic room. In this configuration, an amount of cool air supplied to the magic room can be regulated to control the cooling of the magic room.

According to another aspect of the present invention, the refrigerator further includes a damper installed on the passage to control the cool air supplied to the magic room. In this configuration, whether to supply the cool air to the magic room can be controlled to regulate the cooling of the magic room.

According to another aspect of the present invention, the magic room includes a cool air hole formed on the upper side to introduce the cool air from the passage. In this configuration, the cool air can be supplied smoothly to the magic room.

Advantageous Effects

In the above configuration, as cool air is directly supplied to separate rooms in a freezing chamber and a refrigerating chamber of a refrigerator, the present invention can improve the cooling performance of the separate rooms.

In addition, the present invention provides a refrigerator having a cool air supply passage capable of regulating supply of cool air to a freezing chamber and a special freezing room, and increasing a capacity of the freezing chamber.

Moreover, the present invention provides a refrigerator having a magic room cool air supply passage capable of improving the cooling efficiency of a magic room and easily regulating of cooling the magic room.

Further, the present invention provides a refrigerator capable of suppressing noise generated by a fan for blowing cool air, and preventing freezing of a damper for controlling cool air on a cool air supply passage.

MODE FOR THE INVENTION

Figure 1:
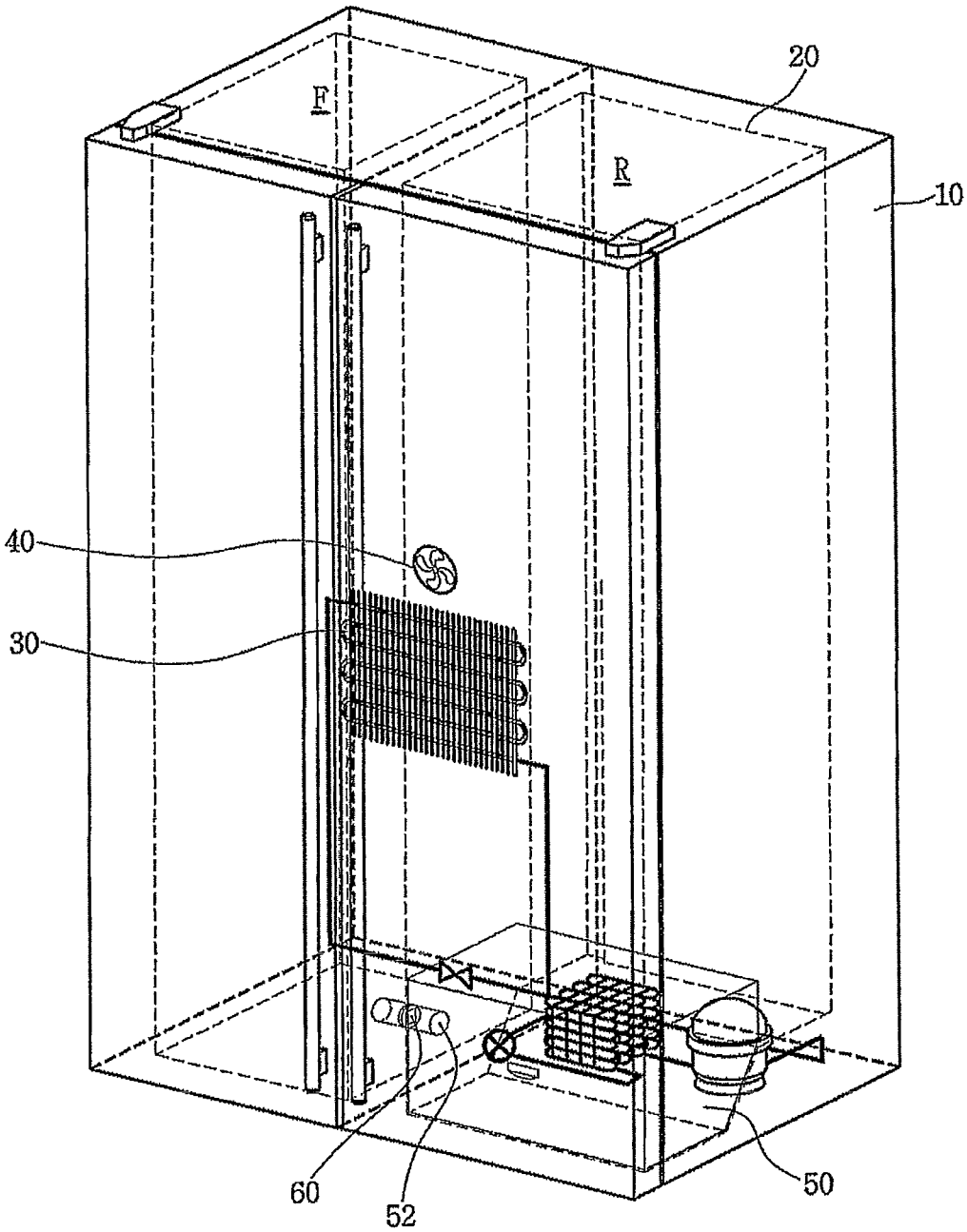
FIG. 1 is a view illustrating one example of a conventional refrigerator.
Figure 2:
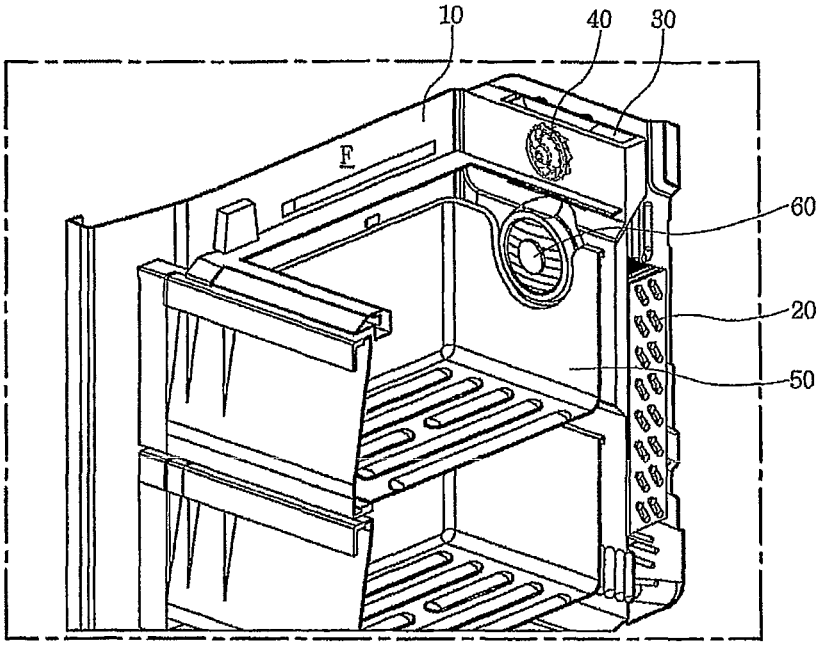
FIG. 2 is a view illustrating another example of the conventional refrigerator.
Figure 3:
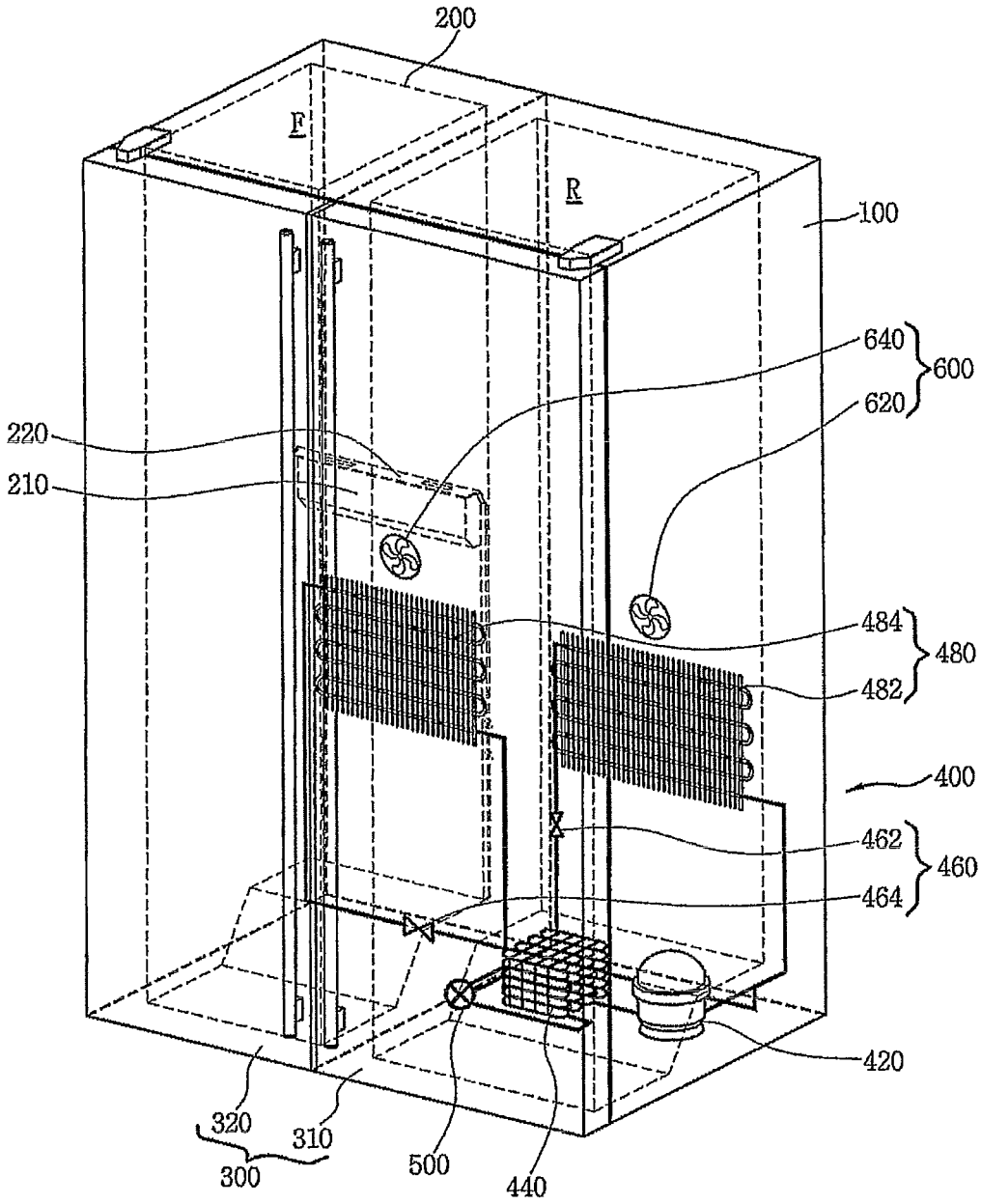
FIG. 3 is a view illustrating a refrigerator according to an embodiment of the present invention.

FIG. 3 is a view illustrating a refrigerator according to an embodiment of the present invention. The refrigerator includes an outer casing 100, an inner casing 200, a door 300 and a freezing cycle 400.

The outer casing 100 forms the exterior of the refrigerator. The inner casing 200 is formed inside the outer casing 100 to define a refrigerating chamber R and a freezing chamber F. In this embodiment, the inner casing 200 is formed inside the outer casing 100 so that the refrigerating chamber R can be defined on the inner right side of the outer casing 100 and the freezing chamber F can be defined on the inner left side of the outer casing 100. In this embodiment, the inner casing 200 includes a front cover 210 and a rear cover 220 constituting at least some portion thereof.

The door 300 opens and closes the refrigerating chamber R or the freezing chamber F defined by the inner casing 200. In this embodiment, the door 300 includes a refrigerating chamber door 310 installed on the right side of the outer casing 100 to open and close the refrigerating chamber R, and a freezing chamber door 320 installed on the left side of the outer casing 100 to open and close the freezing chamber F. In addition, the freezing chamber door 320 may be provided with a dispenser (not shown) so that a user can take out water or ice on the outside of the refrigerator, and the refrigerating chamber door 310 may be provided with a home bar (not shown) so that the user can take out food or beverage stored in the refrigerating chamber R on the outside of the refrigerator.

The freezing cycle 400 is installed between the outer casing 100 and the inner casing 200 to supply cool air to the refrigerating chamber R and the freezing chamber F. Moreover, the freezing cycle 400 includes a condenser 420, a compressor 440, an expansion means 460 and an evaporator 480. The compressor 420 compresses refrigerant into high temperature high pressure refrigerant, the condenser 440 condenses the refrigerant compressed in the compressor 420, the expansion means 460 decompresses the refrigerant condensed in the condenser 440, and the evaporator 480 generates cool air around it by evaporating the refrigerant passing through the expansion means 460. The refrigerating chamber R and the freezing chamber F are cooled by the cool air generated around the evaporator 480.

In this embodiment, the evaporator 480 includes a first evaporator 482 and a second evaporator 484. The first evaporator 482 supplies cool air to the refrigerating chamber R, and the second evaporator 484 supplies cool air to the freezing chamber F. Accordingly, the refrigerating chamber R and the freezing chamber F are independently supplied with cool air. Meanwhile, in this embodiment, the expansion means 460 includes a first expansion means 462 installed on the side of the first evaporator 482, and a second expansion means 464 installed on the side of the second evaporator 484. In this embodiment, the first expansion means 462 and the second expansion means 464 are implemented with capillary tubes.

In this embodiment, the refrigerator further includes a valve 500 for supplying the refrigerant condensed in the condenser 440 to the first evaporator 482 and the second evaporator 484, respectively. The valve 500 is installed between the condenser 440 and the first and second expansion means 462 and 464, supplies some of the refrigerant condensed in the condenser 440 to the first expansion means 462 and the first evaporator 482, and supplies the remaining refrigerant to the second expansion means 464 and the second evaporator 484. Here, in order to regulate the cool air supplied to the refrigerating chamber R and the freezing chamber F, the valve 500 may be implemented with a 3-way valve supplying the refrigerant to at least one of the first evaporator 482 and the second evaporator 484, or intercepting the supplied refrigerant.

The refrigerator includes a blowing fan 600. In this embodiment, the blowing fan 600 includes a first blowing fan 620 for supplying the cool air generated by the first evaporator 482 to the refrigerating chamber R, and a second blowing fan 640 for supplying the cool air generated by the second evaporator 484 to the freezing chamber F. Here, the first blowing fan 620 is installed in the inner casing 200 defining the refrigerating chamber R so as to blow the cool air generated by the first evaporator 482 to the refrigerating chamber R, and the second blowing fan 640 is installed in the inner casing 200 defining the freezing chamber F so as to blow the cool air generated by the second evaporator 484 to the freezing chamber F.

The cool air is supplied to the refrigerating chamber R and the freezing chamber F through the freezing cycle 400 with the above-described configuration. A cooling capability of the cool air supplied to the refrigerating chamber R and the freezing chamber F can be regulated by the refrigerant compressed in the compressor 420, and a cooling quantity thereof can be regulated by the first blowing fun 620 or the second blowing fan 640.

In this embodiment, the inner casing 200 on the installation side of the second evaporator 484 includes the front cover 210 and the rear cover 220. The front cover 210 forms a front surface of at least some portion of the inner casing 200, and the rear cover 220 forms a rear surface of the inner casing 200.

Figure 4:
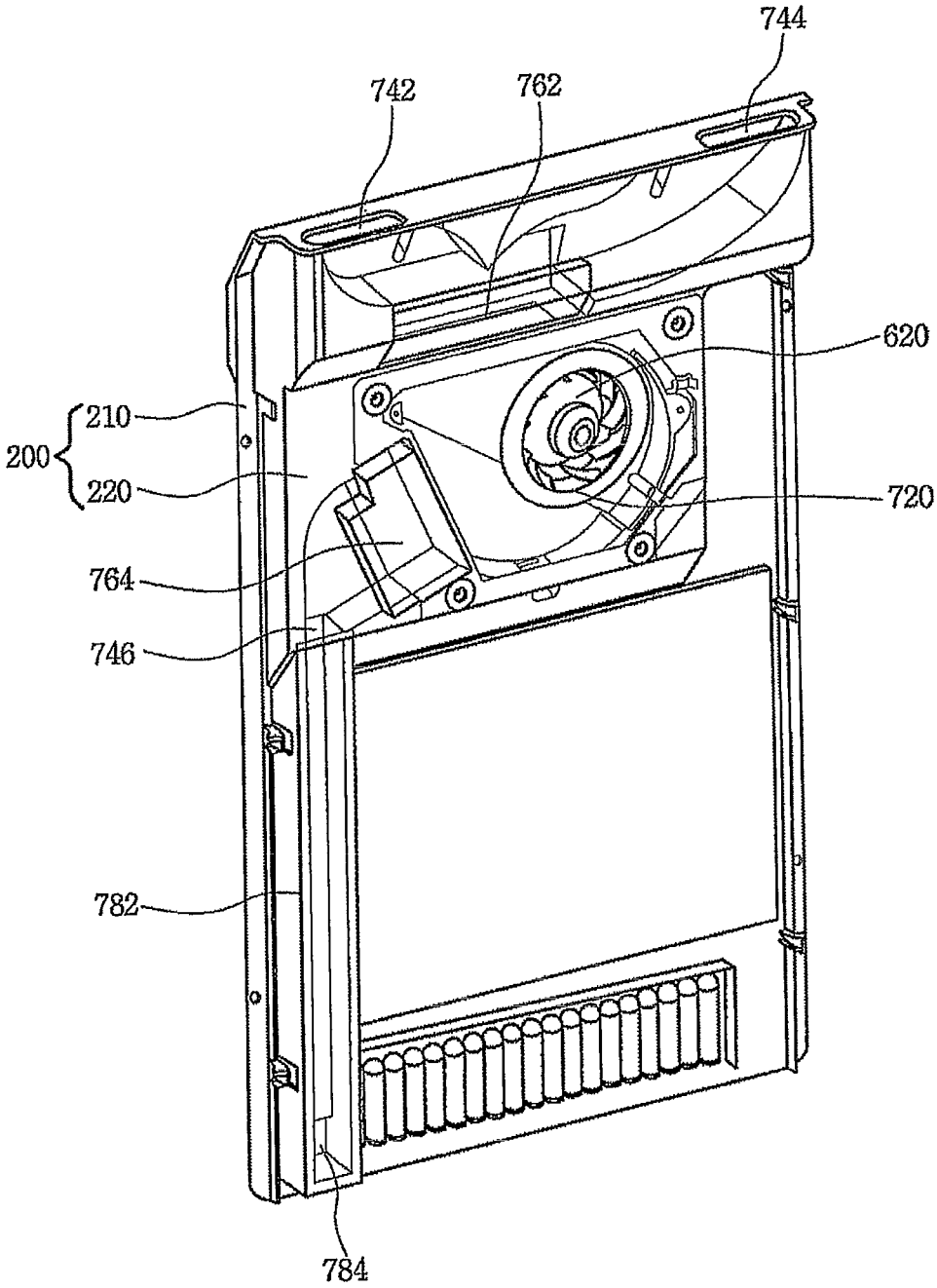
FIG. 4 is a view illustrating one example of an inner casing formed in the refrigerator according to the embodiment of the present invention.

FIG. 4 is a view illustrating one example of the inner casing 200 formed in the refrigerator according to the embodiment of the present invention. The refrigerator includes a cool air supply passage for supplying cool air to the freezing chamber F or the refrigerating chamber R. In this embodiment, the cool air supply passage is formed in the inner casing 200 so that the cool air generated by the evaporator (482 or 484; see FIG. 3) and blown by the blowing fan 620 or 640 can be supplied to the freezing chamber F or the refrigerating chamber R. Particularly, in this embodiment, the cool air supply passage is formed between the front cover 210 and the rear cover 220 of the inner casing 200, and provided with an inlet 720, outlets 742, 744 and 746, and dampers 762 and 764.

The dampers 762 and 764 are installed on the cool air supply passage to regulate the cool air supplied to the freezing chamber F or the refrigerating chamber R through the cool air supply passage. In this embodiment, the dampers 762 and 764 include a main damper 762 installed on the cool air supply passage to regulate the cool air supplied to the freezing chamber F or the refrigerating chamber R through the first outlets 742 and 744, and a separate room damper 764 installed on the cool air supply passage (900; see FIG. 6) to regulate the cool air supplied to the freezing chamber F through the second outlet 746. In this configuration, it is possible to control the cool air flowing in the cool air supply passage.

Figure 5:
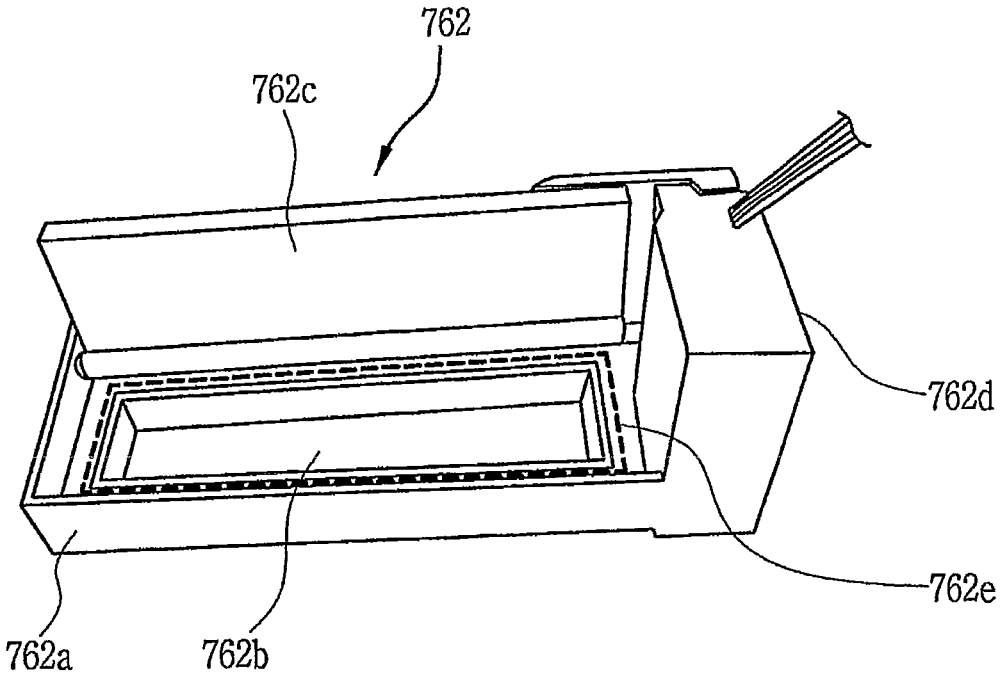
FIG. 5 is a view illustrating one example of a damper formed in the refrigerator according to the embodiment of the present invention.

FIG. 5 is a view illustrating one example of the damper formed in the refrigerator according to the embodiment of the present invention. In this embodiment, the dampers (762 and 764; see FIG. 4) include the main damper 762 and the separate room damper 764 that are identical in structure and operation. Therefore, the main damper 762 will be described as an example.

In this embodiment, the main damper 762 includes a gate 762*a*, an opening and closing member 762*c*, a motor 762*d* and a heater 762*e*. The gate 762*a* is installed on the cool air supply passage, and provided with an opening portion 762*b* so that cool air can pass therethrough. The opening and closing member 762*c* is installed on the gate 762*a* to open and close the opening portion 762*b* of the gate 762*a*. The motor 762*d* is connected to the opening and closing member 762*c* so that the opening and closing member 762*c* can open and close the opening portion 762*b* of the gate 762*a*. In this embodiment, the motor 762*d* is implemented with a step motor moving at a predetermined angle in forward and backward directions.

The heater 762*e* is installed on the main damper 762 to prevent freezing. In this embodiment, the heater 762*e* is installed on the gate 762*a* around the opening and closing member 762*c* so as to prevent the gate 762*a* and the opening and closing member 762*c* from being frozen together. The heater 762*e* is implemented with a hot wire heater. Therefore, although cool air passes through the main damper 762, the main damper 762 is not frozen. As the separate room damper (764; see FIG. 4) is identical to the main damper 762, detailed explanations thereof are omitted.

Figure 6:
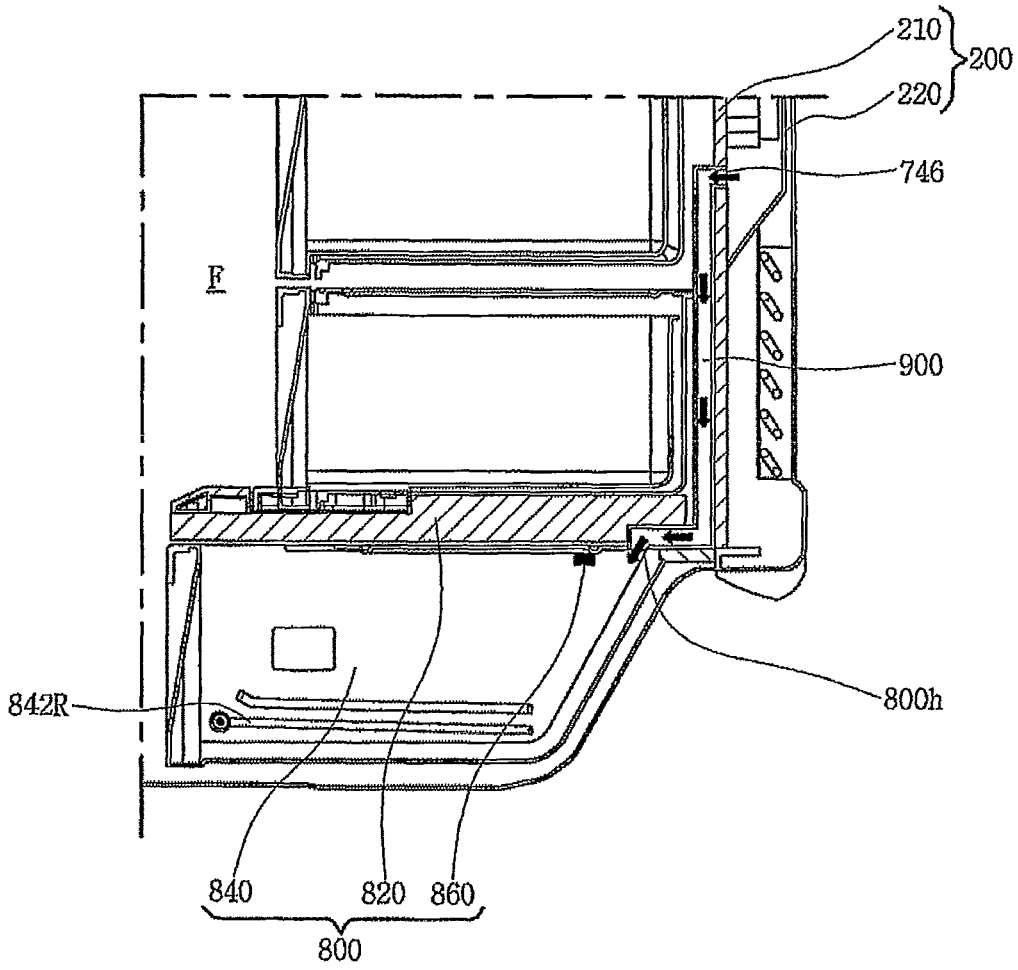
FIG. 6 is a view illustrating one example of a section of the refrigerator according to the present invention.

FIG. 6 is a view illustrating one example of a section of the refrigerator according to the present invention. The refrigerator includes a special freezing room 800 and a special freezing room cool air supply passage 900.

*The special freezing room 800 is positioned in the freezing chamber F to freeze stored articles rapidly. In this embodiment, the special freezing room 800 is positioned in a bottom end of the freezing chamber F to maintain a low temperature state (for example, −35° C.). A temperature sensor 860 is installed to sense a temperature inside the special freezing room 800. Moreover, in this embodiment, the special freezing room 800 includes a casing 820 and a shelf 840. The casing 820 has an open front surface, and the shelf 840 is installed on rails 842R in the casing 820 so that the shelf 840 can be put into and taken out of the casing 820 through the open front surface of the casing 820. Accordingly, a temperature inside the special freezing room 800 may be different from an outside temperature. In addition, a cool air hole 800*h* is formed in the casing 820 to introduce the cool air from the special freezing room cool air supply passage 900.

The special freezing room cool air supply passage 900 is formed in the freezing chamber F to supply the cool air to the special freezing room 800. In this embodiment, the special freezing room cool air supply passage 900 is formed to connect the second outlet 746 to the cool air hole 800*h*. Here, the special freezing room cool air supply passage 900 is implemented with a duct and formed on a front surface of the front cover 210.

Hereinafter, an operation of supplying cool air to the freezing chamber F and the special freezing room 800 according to the present invention will be described in detail with reference to FIGS. 3 to 6.

The refrigerator opens the main damper 762 to send the cool air supplied by the second evaporator 484 to the freezing chamber F. When the main damper 762 is opened, the cool air blown by the second blowing fan 640 is passed through the cool air supply passage, and supplied to the freezing chamber F through the second outlet 746. Here, the special freezing room damper 764 is closed.

When a user intends to use the special freezing room 800, the refrigerator closes the main damper 762 and opens the special freezing room damper 764 so as to send the cool air supplied by the second evaporator 484 to the special freezing room 800. When the special freezing room damper 764 is opened, the cool air blown by the second blowing fan 640 is passed through the cool air supply passage, sent to the special freezing room cool air supply passage 900 through the second outlet 746, and supplied to the special freezing room 800. Therefore, as the cool air generated by the second evaporator 484 is supplied intensively to the special freezing room 800, stored objects can be frozen rapidly.

Here, it is possible to regulate the cool air supplied to the freezing chamber F and the special freezing room 800 by means of the cool air control of the main damper 762 without the cool air control of the special freezing room damper 764. In this case, when the main damper 762 is opened, the cool air is supplied to both the freezing chamber F and the special freezing room 800, and when the main damper 762 is closed, the cool air is not supplied to the freezing chamber F but supplied to the special freezing room 800.

As described above, the cool air supplied to the freezing chamber F or the special freezing room 800 is controlled by the operation of the main damper 762 or the special freezing room damper 764. Thus, the second blowing fan 640 is not frozen due to an operation of intermittently supplying the cool air to the special freezing room 800. Meanwhile, the heaters 762*e* (and not shown) installed in the main damper 762 and the special freezing room damper 764 prevent the main damper 762 and the special freezing room damper 764 from being frozen the to the cool air supplied to the freezing chamber P and the special freezing room 800.

Figure 7:
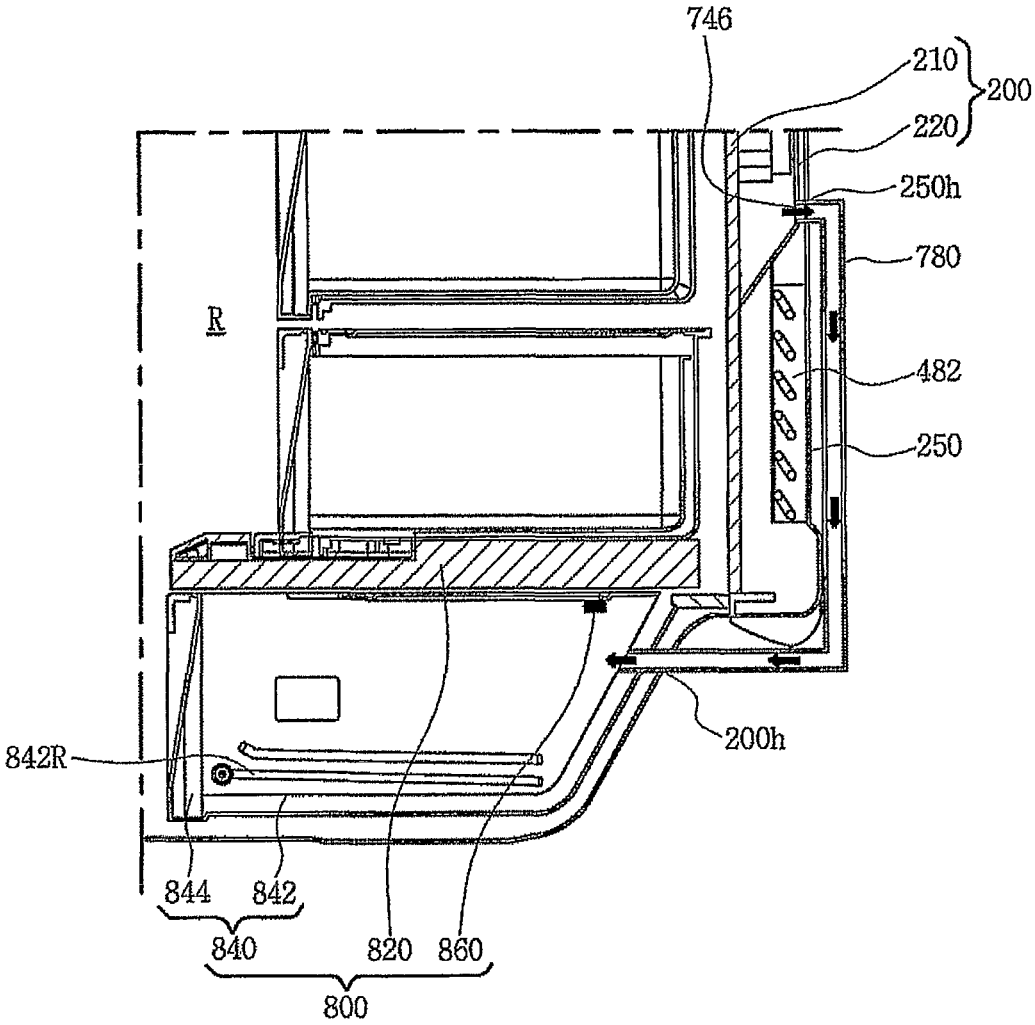
FIG. 7 is a view illustrating another example of the section of the refrigerator according to the present invention.

FIG. 7 is a view illustrating another example of the section of the refrigerator according to the present invention. The refrigerator includes a rear casing 250. The rear casing 250 is positioned between the inner casing 200 and the outer casing (100; see FIG. 3) to cover the front cover 210 and the rear cover 220 of the inner casing 200. In this embodiment, the rear casing 250 is mounted on the rear surface of the inner casing 200 to provide an installation space of the first evaporator 482 and to cover the rear surfaces of the front cover 210 and the rear cover 220 of the inner casing 200. Here, the first evaporator 482 is installed between the rear surface of the front cover 210 of the inner casing 200 and the rear casing 250. Therefore, the cool air generated by the first evaporator 482 is insulated not to exchange heat with the outside and supplied to the first blowing fan (620; see FIG. 3). In this embodiment, a cool air supply passage 780 is formed in the inner casing 200 so that the cool air generated by the first evaporator 482 and blown by the first blowing fan 620 can be supplied to the refrigerating chamber R. The cool air supply passage 780 is controlled by a damper (not shown). The damper is constructed and operated like the damper of FIG. 4.

The refrigerator includes a magic room 800. In this embodiment, the magic room 800 includes a casing 820, a shelf 840 and a temperature sensor 860. The casing 820 is positioned in a bottom end of the refrigerating chamber R, and provided with an open surface. In this embodiment, the open surface of the casing 820 is formed on the front surface of the refrigerating chamber R.

The shelf 840 is installed in the casing 820 to be movable from the inside to outside of the casing 820 and vice versa. In this embodiment, the shelf 840 includes a tray 842 and a cover 844. The tray 842 is formed to receive food or the like thereon, and mounted inside the casing 820 to be movable on rails 842R. The cover 844 is connected to the tray 842 to open and close the open surface of the casing 820.

The temperature sensor 860 is installed inside the magic room 800 to measure a temperature inside the magic room 800.

The refrigerator includes the magic room cool air supply passage 780. The magic room cool air supply passage 780 is installed between the outer casing (100; see FIG. 3) and the rear casing 250 so as to supply the cool air discharged through the second outlet 746 formed in the rear cover 220 of the inner casing 200 to the magic room 800. In this embodiment, the magic room cool air supply passage 780 is implemented with a dirt, and installed in the rear casing 250 to be positioned between the outer casing (100; see FIG. 3) and the rear casing 250. Moreover, in this embodiment, the rear casing 250 includes a connection hole 250*h* so that the magic room cool air supply passage 780 can be connected to the second outlet 746 formed in the rear cover 220 of the inner casing 200. Further, the inner casing 200 includes a cool air hole 200*h* so that the magic room cool air supply passage 780 can be connected to the magic room 800. In this embodiment, the cool air hole 200*h* is formed in the inner casing 200 to be positioned in a rear surface of the magic room 800.

Hereinafter, a process of supplying cool air to the magic room 800 according to the present invention will be described with reference to FIGS. 3, 4 and 7.

The cool air generated by the first evaporator 482 is blown to the second outlet 746 through the inlet 720 formed in the rear cover 220 of the inner casing 200 by the rotation of the first blowing fan (620; see FIGS. 3 and 4). The cool air blown through the second outlet 746 is sent to the rear casing side 250 along the magic room cool air supply passage 780 connected to the second outlet 746. As the magic room cool air supply passage 780 is connected to the cool air hole 200*h* of the inner casing 200, the cool air flowing along the magic room cool air supply passage 780 is supplied to the magic room 800 through the cool air hole 200*h*. Here, the magic room damper 764 installed between the inlet 720 and the outlet 746 regulates supply of the cool air to the magic room 800.

Figure 8:
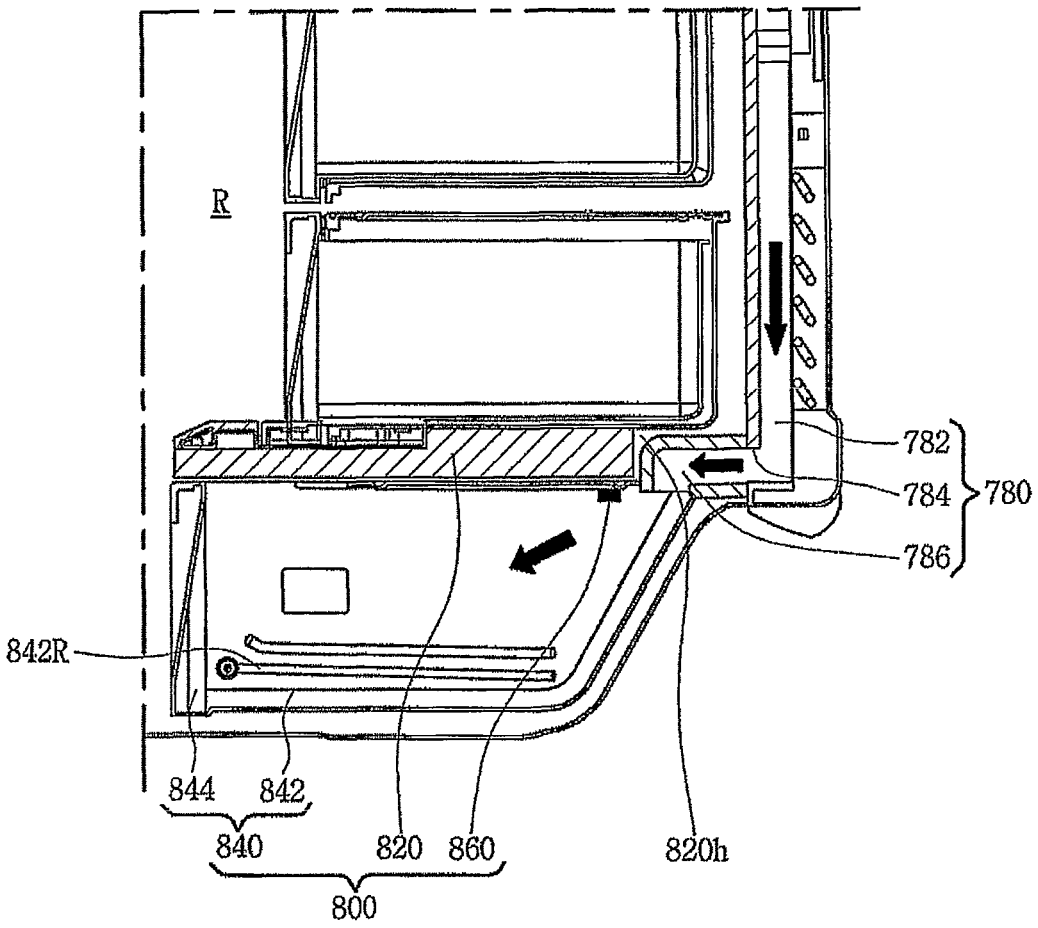
FIG. 8 is a view illustrating a further example of the section of the refrigerator according to the present invention.

FIG. 8 is a view illustrating a further example of the section of the refrigerator according to the present invention. The refrigerator includes a magic room 800. In this embodiment, the magic room 800 includes a casing 820, a shelf 840 and a temperature sensor 860.

The casing 820 is positioned in a bottom end of the refrigerating chamber R and provided with an open surface. In this embodiment, the open surface of the casing 820 is formed on the front suffice of the refrigerating chamber R. In addition, a cool air hole 820*h* is formed on the upper side of the casing 820 to get cool air from the outside of the casing 820. As the cool air hole 820*h* is formed on the upper side of the casing 820, the cool air can be supplied smoothly to the magic room 800.

The shelf 840 is installed in the casing 820 to be movable from the inside to outside of the casing 820 and vice versa. In this embodiment, the shelf 840 includes a tray 842 and a cover 844. The tray 842 is formed to receive food or the like thereon, and mounted inside the casing 820 to be movable on rails 842R. The cover 844 is connected to the tray 842 to open and close the open surface of the casing 820.

The temperature sensor 860 is installed inside the magic room 800 to measure a temperature inside the magic room 800.

Referring to FIGS. 3, 4 and 8, the refrigerator includes a magic room cool air supply passage 780. The magic room cool air supply passage 780 connects the second outlet 746 formed on the side of the front cover 210 of the inner casing 200 to the cool air hole 820*h* formed on the upper side of the casing 820 of the magic room 800 so as to supply the cool air generated by the first evaporator (482; see FIG. 3) to the magic room 800. In this embodiment, the magic room cool air supply passage 780 includes a first duct 782 and a second duct 786. The first duct 782 is formed between the front cover 210 and the rear cover 220 of the inner casing 200 to be connected to the second outlet 746, and the second duct 786 is formed in the front cover 210 to be connected to the cool air hole 820*h*.

Moreover, a connection hole 784 is formed in a bottom end of the front cover 210 of the inner casing 200 to connect the first duct 782 to the second duct 786. As the first duct 782 and the second duct 786 are connected through the connection hole 784, cool air is circulated therein.

Hereinafter, a process of supplying cool air to the magic room 800 according to the present invention will be described. The cool air generated by the first evaporator (482; see FIG. 3) is blown to the second outlet 746 through the inlet 720 formed in the rear cover 220 of the inner casing 200 by the rotation of the first blowing fan (620; see FIG. 3). The cool air blown through the second outlet 746 flows toward the connection hole 784 formed in the front cover 210 of the inner casing 200 along the first duct 782 connected to the second outlet 746. The cool air reaching the connection hole 784 flows along the second duct 786 connected to the first duct 782 through the connection hole 784. As the second duct 786 is connected to the cool air hole 820*h* of the magic room 800, the cool air flowing along the second flint 786 is supplied to the magic room 800 through the cool air hole 820*h*. Here, the magic room damper 764 installed between the inlet 720 and the second outlet 746 regulates the supply of the cool air to the magic room 800.

As the cool air supply passage and the magic room cool air supply passage 780 supply the cool air generated by the first evaporator 482 directly to the magic room 800, the cooling efficiency of the magic room 800 can be improved, and the cooling regulation thereof can be simplified.

While the present invention has been illustrated and described in connection with the accompanying drawings and the preferred embodiments, the present invention is not limited thereto and is defined by the appended claims. Therefore, it will be understood by those skilled in the art that various modifications and changes can be made thereto without departing from the spirit and scope of the invention defined by the appended claims.

The invention claimed is:

1. A refrigerator, comprising:

an outer casing;

an inner casing mounted inside the outer casing to define a refrigerating chamber and a freezing chamber;

an evaporator installed between the outer casing and the inner casing to supply cool air;

a separate room positioned in any one of the refrigerating chamber and the freezing chamber;

a passage for guiding the cool air generated by the evaporator directly to the separate room;

a damper installed on the passage to control the cool air supplied to the separate room, the damper including:

a gate installed on the passage and provided with an opening portion;

an opening and closing member installed on the gate to open and close the opening portion of the gate; and a motor connected to the opening and closing member; and a heater installed on a circumference of the opening portion of the gate on which the opening and closing member contacts, for preventing the gate and the opening and closing member from being frozen together.

2. The refrigerator of claim 1, further comprising a blowing fan formed on the passage to blow cool air.

3. The refrigerator of claim 1, wherein the evaporator supplies cool air to the freezing chamber, wherein the separate room is a special freezing room positioned in the freezing chamber, and wherein the passage guides the cool air generated by the evaporator directly to the special freezing room.

4. The refrigerator of claim 3, wherein the damper supplies cool air to at least one of the freezing chamber and the special freezing room.

5. The refrigerator of claim 4, wherein the damper intercepts the cool air supplied to the freezing chamber, while the cool air is supplied to the special freezing room.

6. The refrigerator of claim 4, wherein the damper further comprises a first damper positioned on the passage on the side of the freezing chamber, and a second damper positioned on the passage on the side of the special freezing room.

7. The refrigerator of claim 3, wherein at least some portion of the passage is a duct for guiding the cool air to the special freezing room.

8. The refrigerator of claim 7, wherein the passage is formed between the outer casing and the inner casing.

9. The refrigerator of claim 1, wherein the evaporator comprises:

a first evaporator for supplying cool air to the refrigerating chamber;

a second evaporator for supplying cool air to the freezing chamber; and the separate room positioned in the refrigerating chamber, wherein the passage guides cool air directly to the separate room.

10. The refrigerator of claim 9, wherein the inner casing comprises a front cover for forming a front surface of the inner casing, and a rear cover for forming a portion of a rear surface of the inner casing, and at least some portion of the passage is formed between the front cover and the rear cover.

11. The refrigerator of claim 10, further comprising a rear casing positioned between the inner casing and the outer casing to cover the front cover and the rear cover of the inner casing, wherein some portion of the passage is a duct installed between the outer casing and the rear casing.

12. The refrigerator of claim 9, wherein the passage is formed in the inner casing.

13. The refrigerator of claim 12, wherein at least some portion of the passage is formed by a duct.

14. The refrigerator of claim 9, further comprising a blowing fan installed on the passage to blow the cool air supplied by the first evaporator to the separate room.

15. The refrigerator of claim 9, wherein the separate room comprises a cool air hole formed on the upper side to introduce the cool air from the passage.

* * * * *